US007815468B2

(12) United States Patent
Mizukami

(10) Patent No.: US 7,815,468 B2
(45) Date of Patent: Oct. 19, 2010

(54) CONNECTOR

(75) Inventor: Kazuhiro Mizukami, Shinagawa (JP)

(73) Assignee: Fujitsu Component Limited, Tokyo (JP)

( * ) Notice: Subject to any disclaimer, the term of this patent is extended or adjusted under 35 U.S.C. 154(b) by 0 days.

(21) Appl. No.: 12/504,705

(22) Filed: Jul. 17, 2009

(65) Prior Publication Data

US 2010/0216347 A1 Aug. 26, 2010

(30) Foreign Application Priority Data

Feb. 26, 2009 (JP) ..... 2009-043904

(51) Int. Cl.
*H01R 13/648* (2006.01)

(52) U.S. Cl. ..... 439/607.34; 439/108

(58) Field of Classification Search ..... 439/607.34, 439/607.05–607.07, 607.54, 108
See application file for complete search history.

(56) References Cited

U.S. PATENT DOCUMENTS 3,587,029 A * 6/1971 Knowles ..... 439/607.34
5,921,814 A * 7/1999 Maruyama ..... 439/607.35
6,066,000 A * 5/2000 Masumoto et al. ..... 439/607.34
7,029,330 B1 * 4/2006 Ro ..... 439/607.01

FOREIGN PATENT DOCUMENTS

JP 05-275139 10/1993

* cited by examiner

*Primary Examiner*—Gary F. Paumen
(74) *Attorney, Agent, or Firm*—IPUSA, PLLC

(57) ABSTRACT

A connector to be engaged with and connected to an opponent connector, the connector includes a ground plate extending in a first direction; plural signal contacts placed side by side in the first direction, the plural signal contacts being configured to come in contact with corresponding plural signal contacts of the opponent connector; and plural ground contacts placed side by side in the first direction, the plural ground contacts being configured to come in contact with corresponding plural ground contacts of the opponent connector; wherein the ground plate and the ground contacts are formed in a body by processing a single metal plate; and the opponent connector side of the ground plate and the opponent connector side of the ground contacts are electrically connected to each other.

6 Claims, 17 Drawing Sheets

CONNECTOR

CROSS-REFERENCE TO RELATED APPLICATIONS

This patent application is based upon and claims the benefit of priority of Japanese Patent Application No. 2009-43904 filed on Feb. 26, 2009, the entire contents of which are incorporated herein by reference.

BACKGROUND OF THE INVENTION

1. Field of the Invention

The present invention generally relates to connectors. More specifically, the present invention relates to a connector, such as a balanced transmission connector, to be engaged with and connected to an opponent connector.

2. Description of the Related Art

As ways for transmitting data, there are a normal transmission type and a balanced transmission type. In the normal transmission type, a single electric wire is used for every data stream. In the balanced transmission type, two electric wires which form a couple for every data stream are used so that a positive signal and a negative signal having the same size as that of the positive signal but having a different direction from that of the positive signal are simultaneously transmitted. The balanced transmission type, compared to the normal transmission type, has an advantage in that there may not be noise influence. Accordingly, the balanced transmission type has been widely used in fields where signals are transmitted at high speed.

FIG. 1 is a schematic perspective view of a related art balanced transmission connector device. FIG. 2 is a schematic view showing structures of surfaces facing each other of a plug connector 2 and a jack connector 3.

A balanced transmission connector device 1 includes the plug connector 2 and the jack connector 3. The plug connector 2 is attached to a back plane (outside board) 4. The jack connector 3 is mounted on a daughter board (outside board) 5. The plug connector 2 and the jack connector 3 are connected to each other so that the back plane 4 and the daughter board 5 are electrically connected to each other by the connector device 1. See, for example, Japanese Laid-Open Patent Application Publication No. 5-275139.

As shown in FIG. 1 and FIG. 2, the plug connector 2 includes plural signal contact pairs 12, plural ground contacts 18, and a U-shaped insulation housing 6. The ground contact 18 has a reverse L-shaped configuration. A ground contact 18 is provided for every signal contact pair 12. The insulation housing 6 is configured to support plural signal contact pairs 12 and plural ground contacts 18.

The signal contact pairs 12 are placed side by side in a row direction (X1-X2 direction) and a line direction (Y1-Y2 direction). Each of the signal contact pairs 12 is formed by signal contacts 14 and 16. The signal contacts 14 and 16 are configured to transmit signals having positive and negative symmetric waveforms. The signal contacts 14 and 16 are arranged in the row direction (X1-X2 direction).

Each of the ground contacts 18 includes a horizontal plate part 18-1 and a vertical plate part 18-2. Each of the ground contacts 18 is configured to cover a Y1 side and an X2 side of the corresponding signal contact pair 12. The horizontal plate part 18-1 extends to a rear side of the housing 6 so as to work as a terminal part.

The jack connector 3, as shown in FIG. 1 and FIG. 2, includes an insulation housing 7, plural modules 8, and plural ground plates (shield plates) 9.

The insulation housing 7 includes openings 74 and 76 and a reverse L-shaped slit 78 corresponding to the ground contact 18 of the plug connector 2. The openings 74 and 76 correspond to the signal contacts 14 and 16 of the plug connector 2.

The modules 8 are placed side by side in the line direction (Y1-Y2 direction). Each of the modules 8 includes four signal contact pairs 22. The signal contact pairs 22 are placed side by side in the row direction (X1-X2 direction). Each of the signal contact pairs 22 includes signal contacts 24 and 26. The signal contacts 24 and 26 are configured to transmit signals having positive and negative symmetric waveforms. The signal contact pairs 24 and 26 are placed side by side in the row direction (X1-X2 direction).

The ground plates 9 are arranged, one by one, between neighboring modules 8.

FIG. 3 is a cross-sectional view of an electrical connecting part of the plug connector 2 and the jack connector 3.

The housing 7 (see FIG. 2) is engaged with the housing 6 (see FIG. 3) and the signal contacts 14 and 16 are inserted in the housing 6 via the openings 74 and 76 and come in contact with the signal contacts 24 and 26, respectively, so that the plug connector 2 and the jack connector 3 are electrically connected to each other.

The ground contact 18 is inserted in the housing 6 via the slit 76. The vertical plate part 18-2 is arranged at a Y1 side of the electrical connection part of the signal contact pair 12 and the signal contact pair 22. The horizontal plate part 18-1 is arranged at an X2 side of the electrical connection part of the signal contact pair 12 and the signal contact pair 22.

Under this structure, the ground contact 18 or the ground plate 9 is arranged between the neighboring signal contacts at the connection part of the plug connector 2 and the jack connector 3. Accordingly, it is possible to prevent cross-talk between neighboring signals and to transmit the signals at high speed.

However, in the structure suggested in Japanese Laid-Open Patent Application Publication No. 5-275139, when the plug connector 2 and the jack connector 3 are connected to each other, the ground contact 18 and the ground plate 9 do not come in contact with each other. Accordingly, a head end side (Z1 side) of the ground contact 18 or a head end side (Z2 side) of the ground plate 9 is a stub of the transmission path. Therefore, an effect of a ground against the high frequency signal is weak and ground potential may fluctuate.

SUMMARY OF THE INVENTION

Accordingly, embodiments of the present invention may provide a novel and useful connector solving one or more of the problems discussed above.

More specifically, the embodiments of the present invention may provide a connector whereby it is possible to improve an effect of a ground against high frequency signals.

Another aspect of the present invention may be to provide a connector to be engaged with and connected to an opponent connector, the connector including:

a ground plate extending in a first direction;

plural signal contacts placed side by side in the first direction, the plural signal contacts being configured to come in contact with corresponding plural signal contacts of the opponent connector; and plural ground contacts placed side by side in the first direction, the plural ground contacts being configured to come in contact with corresponding plural ground contacts of the opponent connector;

wherein the ground plate and the ground contacts are formed in a body by processing a single metal plate; and the opponent connector side of the ground plate and the opponent connector side of the ground contacts are electrically connected to each other.

According to the embodiments of the present invention, it is possible to provide a connector whereby it is possible to improve an effect of a ground against high frequency signals.

Additional objects and advantages of the embodiments are set forth in part in the description which follows, and in part will become obvious from the description, or may be learned by practice of the invention. The object and advantages of the invention will be realized and attained by means of the elements and combinations particularly pointed out in the appended claims. It is to be understood that both the foregoing general description and the following detailed description are exemplary and explanatory and are not restrictive of the invention as claimed.

DETAILED DESCRIPTION OF THE PREFERRED EMBODIMENTS

A description is given below, with reference to the FIG. 4 through FIG. 17 of embodiments of the present invention.

Figure 1:
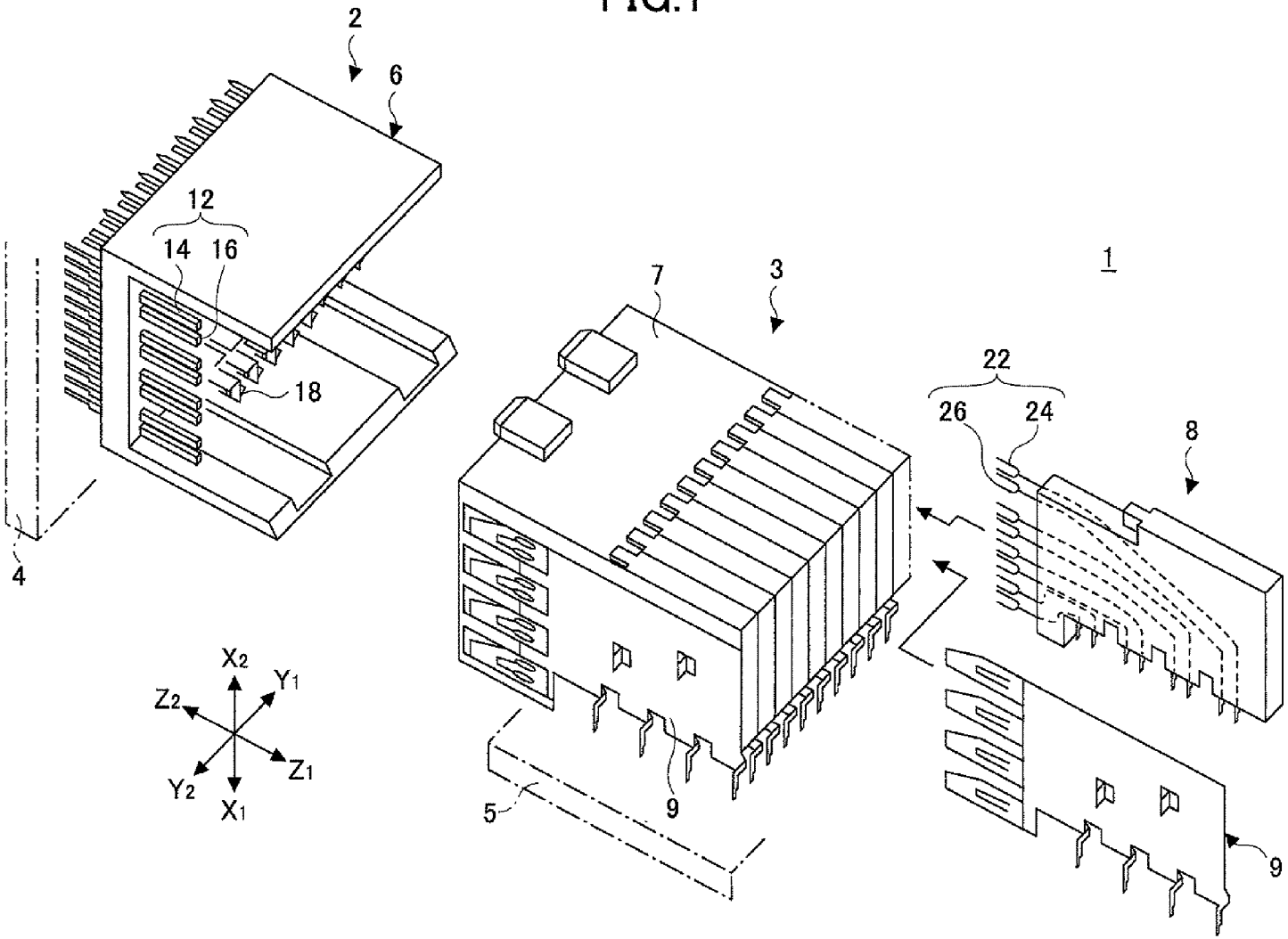
FIG. 1 is a schematic perspective view of a related art balanced transmission connector device.
Figure 2:
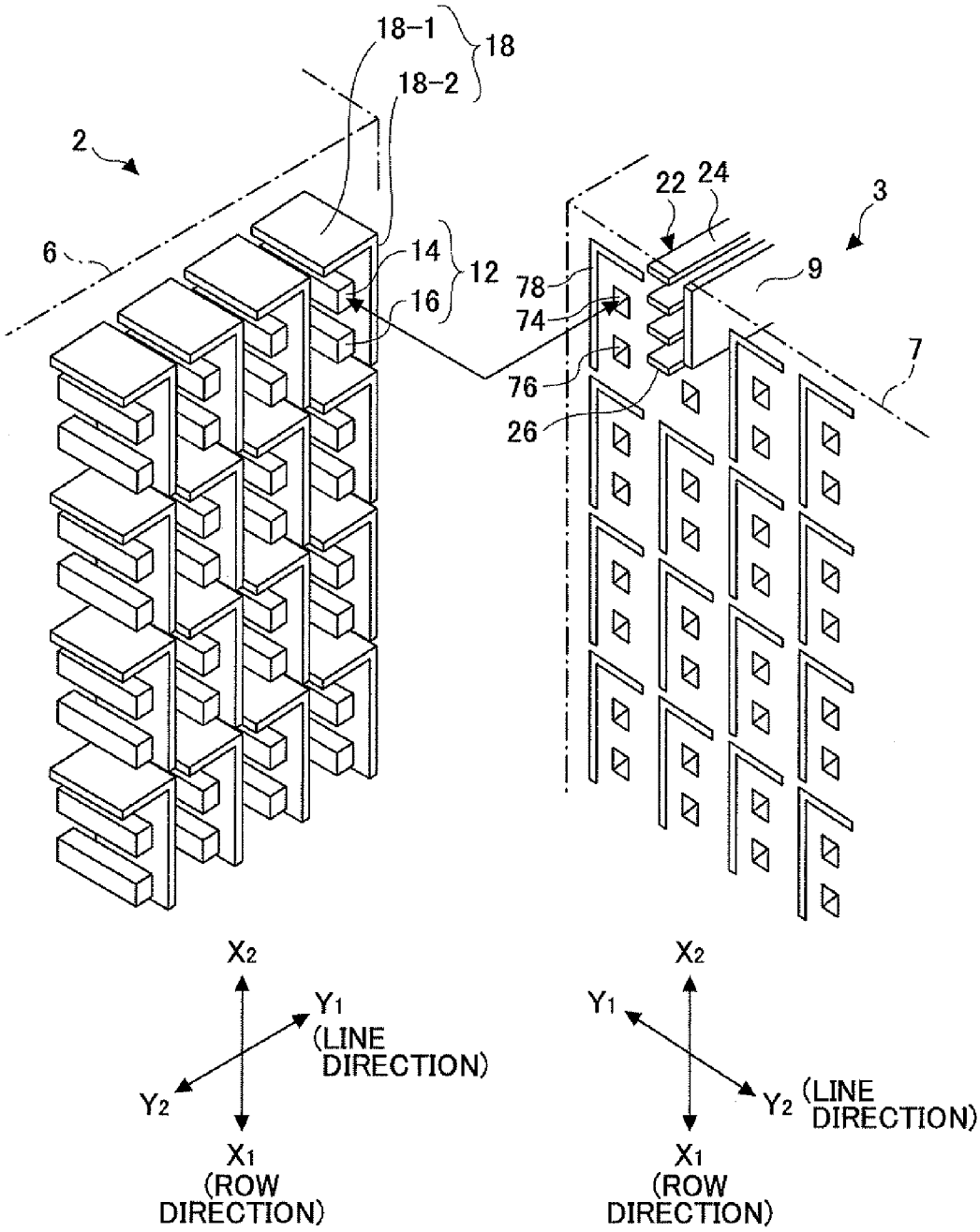
FIG. 2 is a schematic view showing structures of surfaces facing each other of a plug connector 2 and a jack connector 3.
Figure 3:
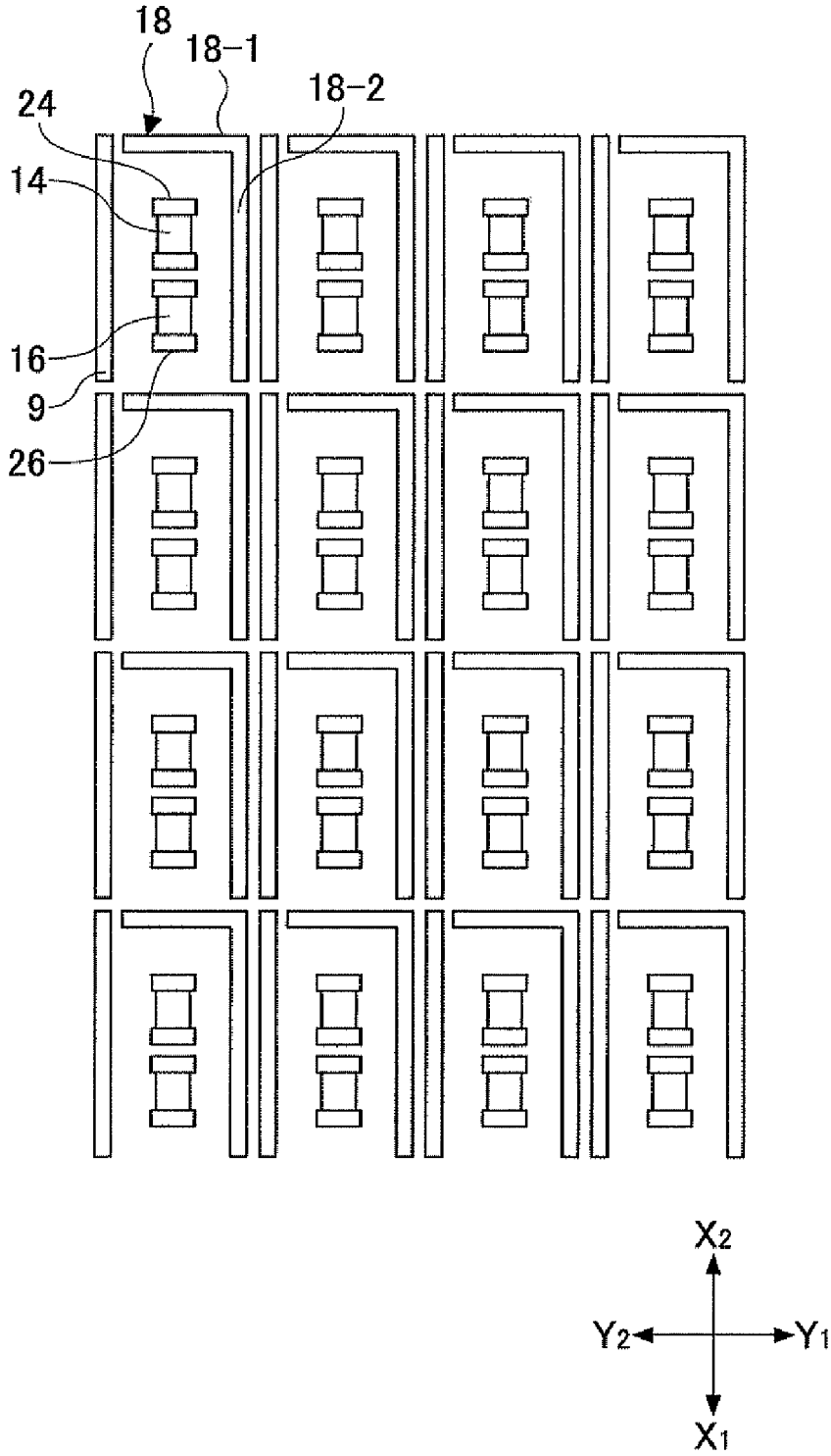
FIG. 3 is a cross-sectional view of an electrical connecting part of the plug connector 2 and the jack connector 3.

In each of the drawings, an X1-X2 direction represents a row direction; a Y1-Y2 direction represents a line direction (first direction); and a Z1-Z2 direction represents a connection direction of a plug connector 2A and a jack connector 3A. The X1-X2 direction, the Y1-Y2 direction, and the Z1-Z2 direction are orthogonal with each other. In FIG. 4 through FIG. 17, parts that are the same as the parts shown in FIG. 1 through FIG. 3 are given the same reference numerals with suffixes (subscripts), and explanation thereof is omitted.

FIRST EXAMPLE

Figure 4:
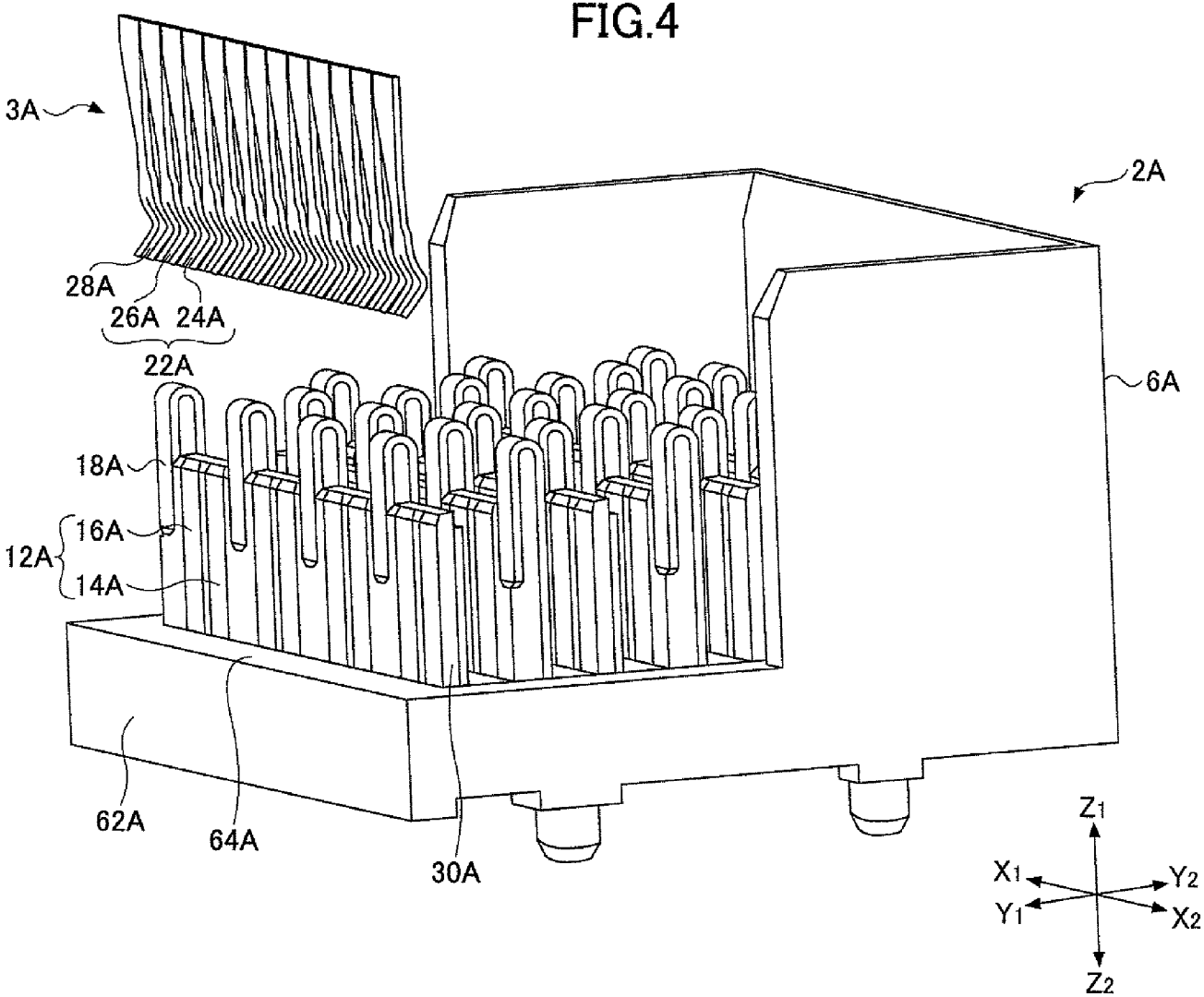
FIG. 4 is a perspective view of a connector 2A of a first example of the present invention and an opponent connector 3A.

FIG. 4 is a perspective view of a connector 2A of a first example of the present invention and an opponent connector 3A.

In an insulation housing 6A of the connector 2A, plural contacts 14A, 16A and 18A are placed side by side in the row direction (X1-X2 direction) and in the line direction (Y1-Y2 direction). In an insulation housing (not illustrated in FIG. 4) of the opponent connector 3A, plural openings (not illustrated in FIG. 4) corresponding to the plural contacts 14A, 16A, and 18A of the connector 2A are formed. In the insulation housing of the opponent connector 3A, plural contacts 24A, 26A, and 28A are placed side by side in the row direction (X1-X2 direction) and in the line direction (Y1-Y2 direction).

The contacts 14A, 16A, and 18A of the connector 2A are inserted from the corresponding openings to an inside of the opponent connector 3A so as to come in contact with the corresponding contacts 24A, 26A, and 28A of the opponent connector 3A, so that the connector 2A and the opponent connector 3A are electrically connected to each other.

A structure of the connector 2A is discussed below.

The insulation housing 6A has a closed-end solid body-shaped configuration. Plural projection parts 30A are provided on an internal surface 64A of a bottom wall 62A of the insulation housing 6A. The projection parts 30A extend in the row direction (X1-X2 direction) and are placed side by side in the line direction (Y1-Y2 direction). Plural projection parts 30A may be formed in a body with the insulation housing 6A. The plural projection parts 30A may be formed separately from the insulation housing 6A and may be attached to the insulation housing 6A. The projection parts 30A have insulation.

FIG. 5(A) is a front view showing a structure of a projection part 30A. FIG. 5(B) is a view taken along line A-A. FIG. 5(C) is a view taken along line B-B. FIG. 5(D) is a view taken along line C-C. FIG. 6 is a view showing fitting states of the contacts 14A, 16A and 18A. FIG. 6(A) through FIG. 6(D) correspond to FIG. 5(A) through FIG. 5(D), respectively.

In a Y1 side surface 32A of the projection part 30A, plural grooves 34A and 36A for signals are formed side by side in the row direction (X1-X2 direction). The signal contacts 14A and 16A are press fitted in and fixed to the grooves 34A and 36A, respectively.

Furthermore, in the Y1 side surface 32A of the projection part 30A, plural grooves 38A for ground are formed side by side in the row direction (X1-X2 direction). The ground contacts 18A are press fitted in and fixed to the corresponding grooves 38A. Pairs of the grooves 34A and 36A and the grooves 38 are alternately placed side by side in the row direction (X1-X2 direction).

Figure 7:
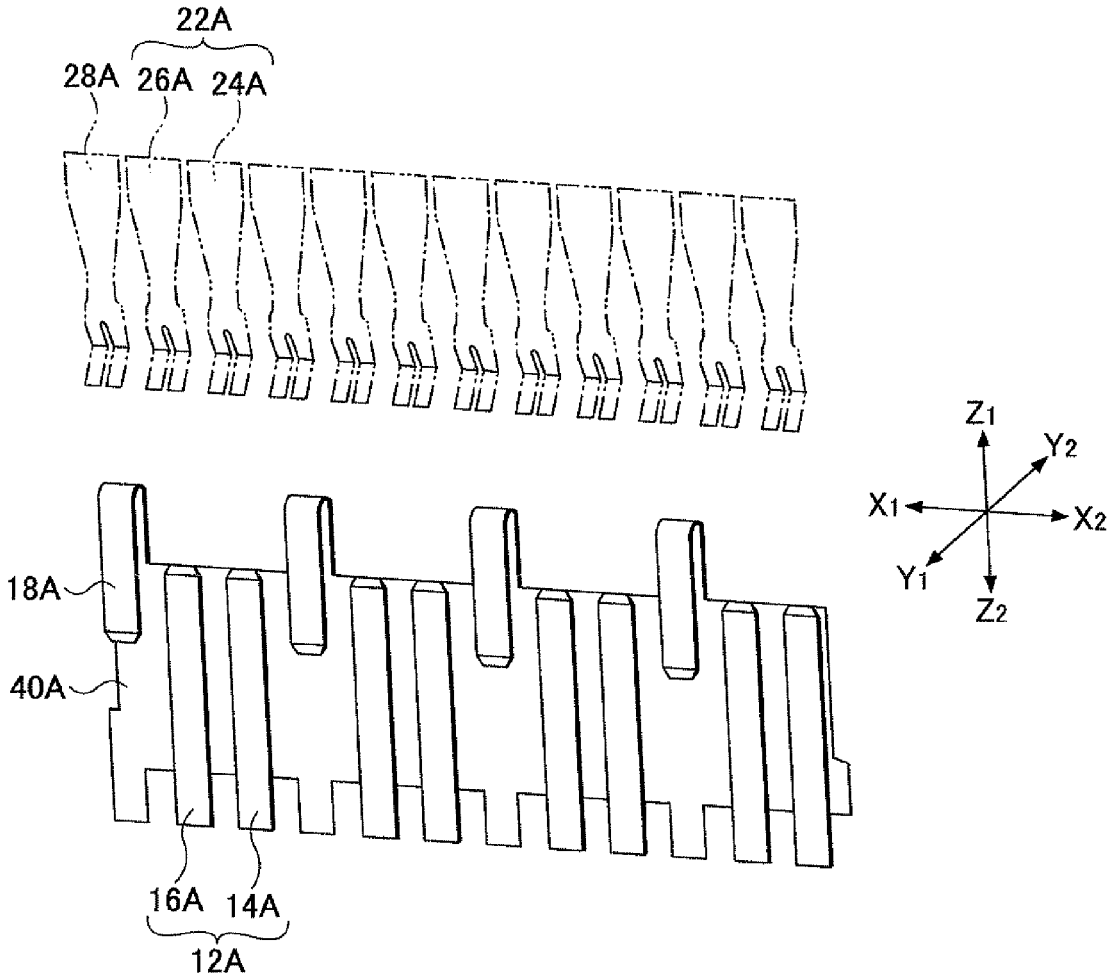
FIG. 7 is a perspective view showing a unit structure of the connector 2A.

FIG. 7 is a perspective view showing a unit structure of the connector 2A. The connector 2A is formed by plural unit structures placed side by side in the line direction (Y1-Y2 direction).

A single unit structure includes a ground plate (shield plate) 40A, plural of the signal contacts 14A and 16A, and plural of the ground contacts 18A. The ground plate (shield plate) 40A extends in the row direction (X1-X2 direction). The signal contacts 14A and 16A are placed side by side in the row direction (X1-X2 direction). The signal contacts 14A and 16A are provided so as to come in contact with the signal contacts 24A and 26A of the opponent connector 3A. The ground contacts 18A are placed side by side in the row direction (X1-X2 direction). The ground contacts 18A are provided so as to come in contact with the ground contacts 28A of the opponent connector 3A.

In a single unit structure, a pair of the signal contacts 14A and 16A neighboring in the row direction (X1-X2 direction) form the signal contact pair 12A configured to transmit signals having positive and negative symmetric waveforms.

The ground contacts 18 are provided between the neighboring signal contact pairs 12A. The ground contacts 18 are provided, one by one, at the X1 side or the X2 side of every signal contact pair 12A. In other words, the signal contact pairs 12A and the ground contacts 18A are alternately placed side by side in the row direction (X1-X2 direction).

The signal contacts 14A and 16A, as illustrated in FIG. 6, are press fitted in and fixed to the corresponding grooves. The signal contacts 14A and 16A extend to a bottom side (Z2 side) of the bottom wall 62A of the insulation housing 6A so as to form a terminal part. The terminal part may have a configuration so as to be press-fitted in and fixed to a through hole of an outside board (back plane). The terminal part may have a configuration whereby the terminal part can be surface mounted on the outside board. There is no limitation of the configuration of the terminal part.

The ground contacts 18A are, as illustrated in FIG. 6, press fitted in and fixed to the corresponding grooves 38A. The ground contacts 18A, compared to the signal contacts 14A and 16A, project more to a Z1 side, which is the opponent connector 3A side. Because of this, when the connector 2A and the opponent connector 3A are connected to each other, it is possible to make the ground contacts 18A come in contact with the opponent contacts before the signal contacts 14A and 16A come in contact with the opponent contacts. As a result of this, it is possible to discharge static electricity first so that a device system can be protected.

Surfaces of the ground plates 40A, as illustrated in FIG. 6, come in contact with rear surfaces of the corresponding projection parts 30A. The ground plates 40 extend to a bottom side (Z2 side) of the bottom wall 62A of the insulation housing 6A so that a terminal part is formed. The terminal part may have a configuration so as to be press-fitted in and fixed to a through hole of an outside board (back plane). The terminal part may have a configuration whereby the terminal part can be surface mounted on the outside board. There is no limitation of the configuration of the terminal part.

In the unit structure, the ground plate 40A and plural ground contacts 18A are formed in a body by processing a single metal plate. The opponent connector 3A side (Z1 side) of the ground plate 40A and the opponent connector 3A side (Z1 side) of the ground contacts 1SA are electrically connected to each other.

In the example shown in FIG. 7, the ground plate 40A and plural ground contacts 18A are formed in a body by punching a single metal plate and bending a comb teeth-shaped part in a U-shaped manner. Each of plural bent pieces of the metal plate forms one of the ground contacts 18A. Thus, since the ground plate 40A and plural ground contacts 18A are formed in a body, it is possible to decrease the number of components.

Figure 8:
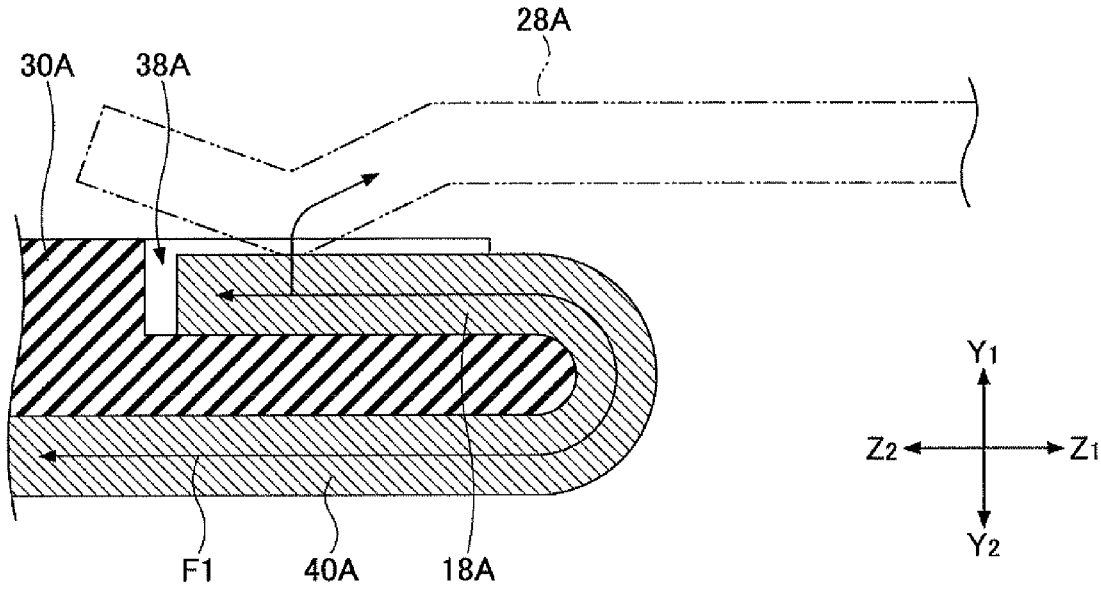
FIG. 8 is a cross-sectional view of a transmission path of a ground plate 40A and a ground contact 18A.

FIG. 8 is a cross-sectional view of a transmission path of the ground plate 40A and the ground contact 18A. In FIG. 8, an arrow F1 indicates the transmission path. Since the opponent connector 3A side (Z1 side) of the ground plate 40A and the opponent connector 3A side (Z1 side) of the ground contacts 18A are electrically connected to each other, it is possible to make the stub of the transmission path F1 narrow. Because of this, it is possible to prevent fluctuations of ground potential even in a case of high speed transmission. Hence, it is possible to improve an effect of ground against high frequency signals.

This effect can be achieved in a case where the ground contacts 18A, compared to the signal contacts 14A and 16A, project more to the Z1 side which is the opponent connector 3A side.

Figure 9:
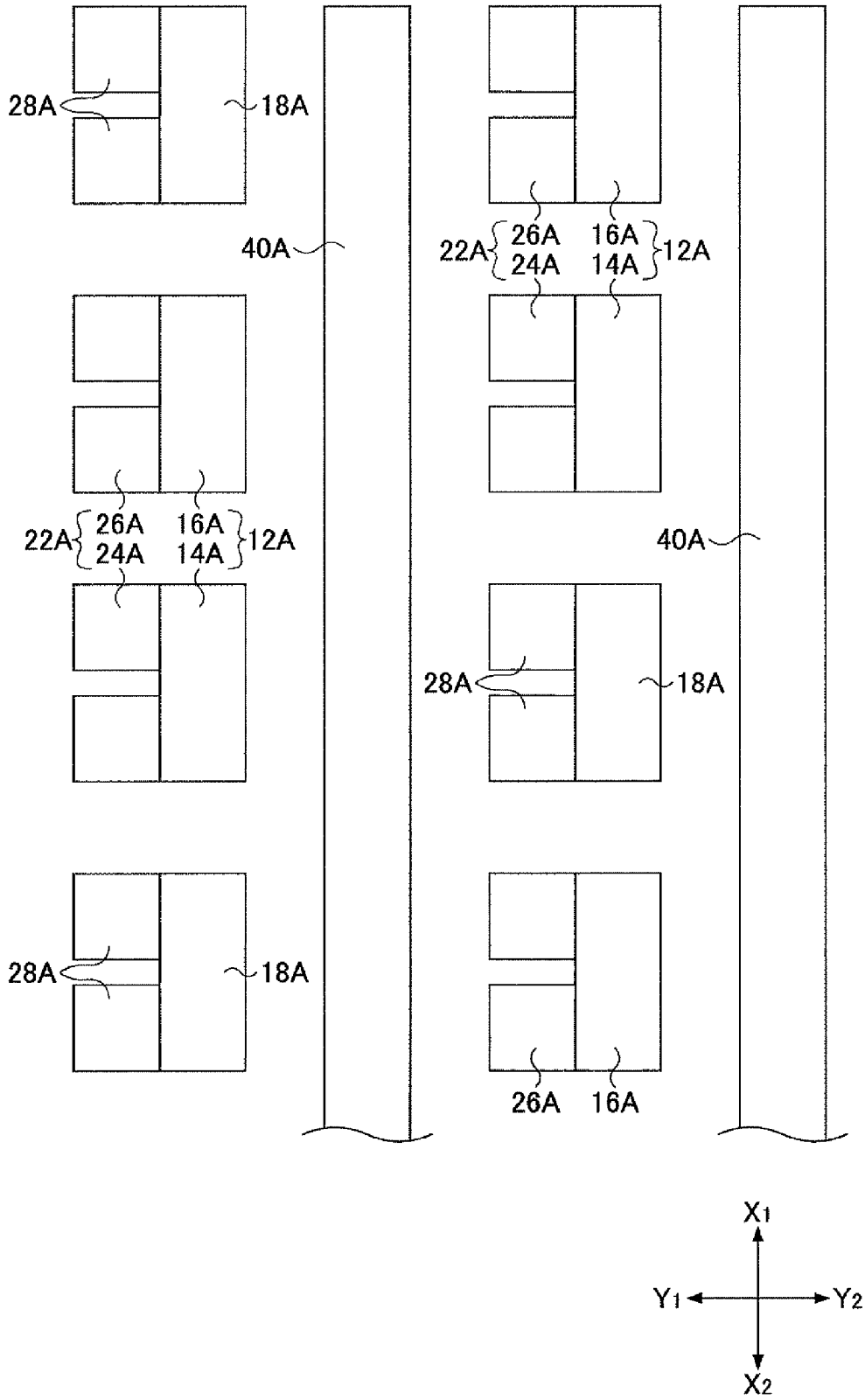
FIG. 9 is a cross-sectional view schematically showing a connection part of the connector 2A and the opponent connector 3A.

Next, a connection part of the connector 2A and the opponent connector 3A is discussed with reference to FIG. 9. FIG. 9 is a cross-sectional view schematically showing the connection part of the connector 2A and the opponent connector 3A.

The contacts 14A, 16A, and 18A of the connector 2A are inserted from the corresponding openings to an inside of the opponent connector 3A so as to come in contact with the corresponding contacts 24A, 26A, and 28A of the opponent connector 3A, so that the connector 2A and the opponent connector 3A are electrically connected to each other.

At this time, the ground contacts 18A and 28A and the ground plate 40A are arranged between the neighboring signal pairs (the electrical connection part between the signal contact pairs 12A and the opponent signal contact pairs 22A). As a result of this, it is possible to prevent cross-talk between neighboring signals and to transmit the signals at high speed.

SECOND EXAMPLE

Figure 10:
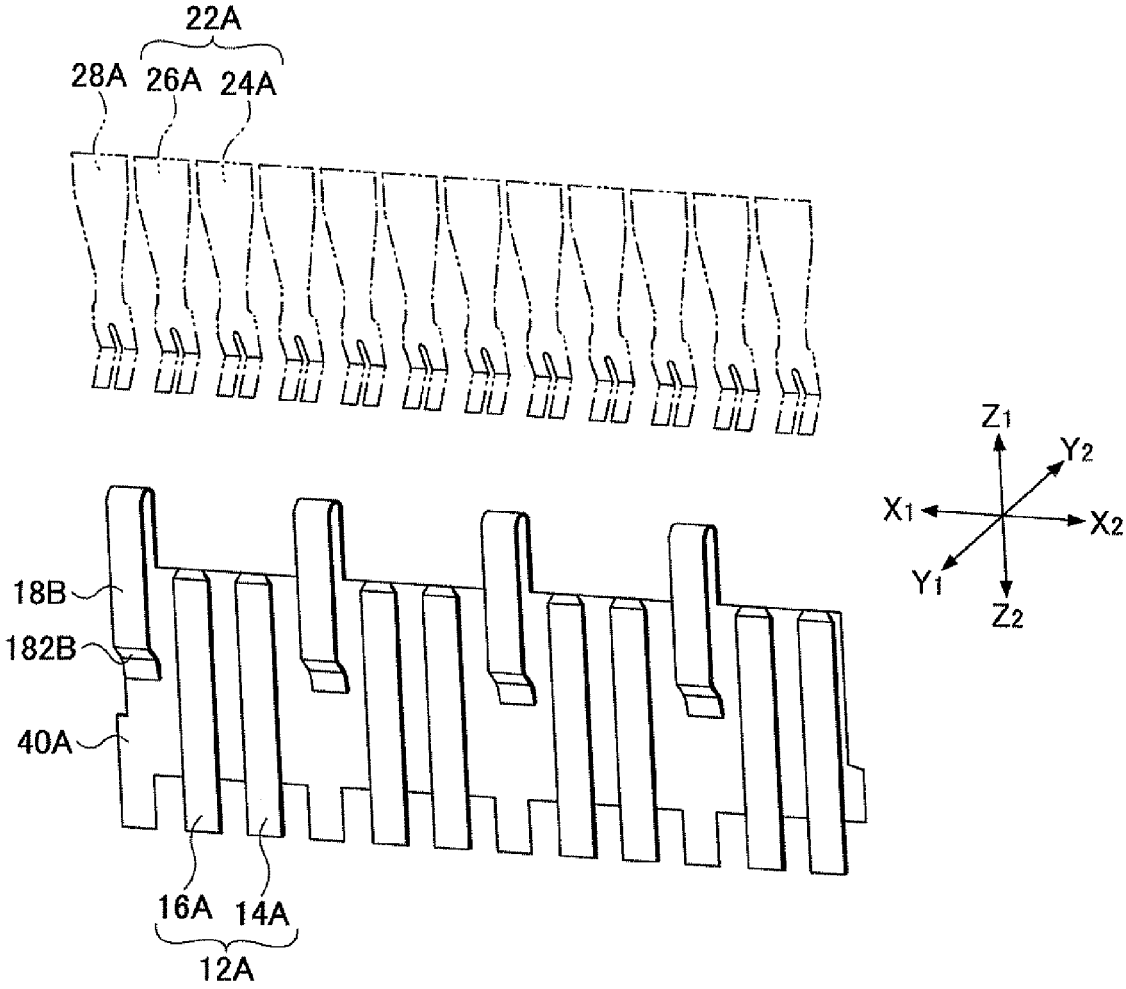
FIG. 10 is a perspective view showing a unit structure of a connector 2B.

A connector 2B of the second example of the present invention, compared to the connector 2A illustrated in FIG. 4, includes a ground contact 18B illustrated in FIG. 10 instead of the ground contact 18A illustrated in FIG. 7.

FIG. 10 is a perspective view showing a unit structure of the connector 2B.

In the unit structure, the ground contacts 18B, the same as the ground contacts 18A, are formed in a body by punching a single metal plate and bending a comb teeth-shaped part in a U-shaped manner. The ground contacts 18B are formed in a body with the ground plate 40A. Because of this, it is possible to decrease the number of components.

In the ground contact 18B compared to the ground contact 18A, the U-shaped part is bent so as to be separated from the groove 38A. A head end part 182B is bent in the Y2 direction so as to be press fitted in and fixed to the groove 38A and obliquely extend in the Z2 direction.

The head end part 182B forms a contact part 182B whose surface can come in contact with the surface of the opponent ground contact 28A. The head end part 182B has a tilted surface which can come in contact with an elastically deformable V-shaped head end of the opponent ground contact 28A. Since the surface of the ground contact 18B and the surface of the opponent ground contact 28A come in contact with each other, it is possible to prevent a bad or incomplete contact. Because of this, it is possible to improve the effect of ground against high frequency signals.

Plural contact parts 182B are provided between the neighboring signal contact pairs 12A one by one and at the X1 side or the X2 side for all of the signal contact pairs 12A one by one. In other words, the signal contacts 12A and the contact parts 182B are alternately placed side by side in the row direction (X1-X2 direction).

Figure 11:
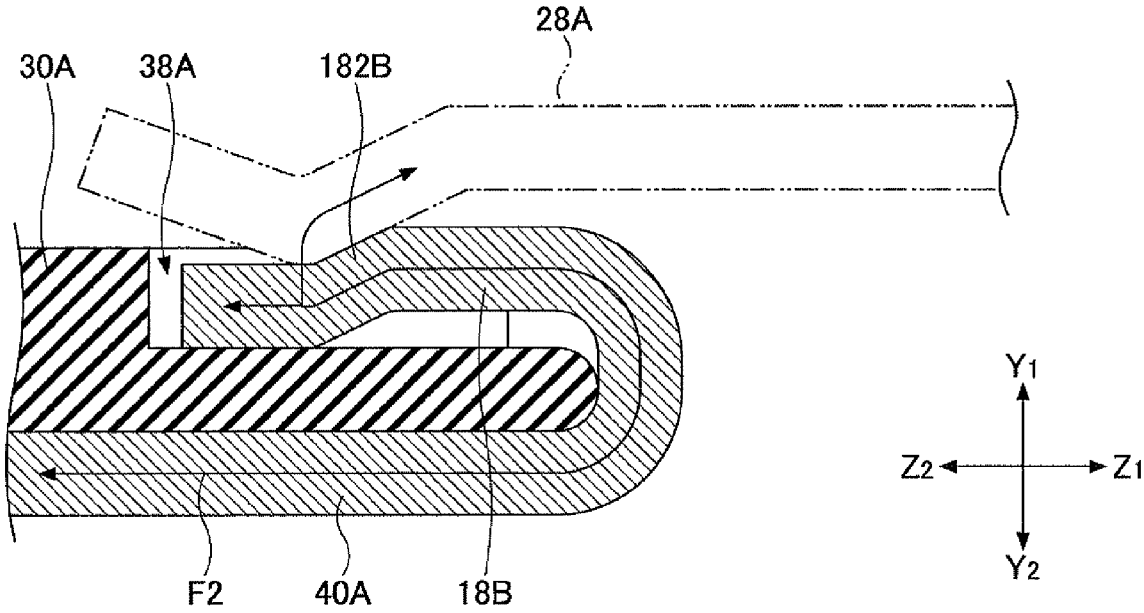
FIG. 11 is a cross-sectional view of the transmission path of a ground plate 40A and a ground contact 18B.

FIG. 11 is a cross-sectional view of the transmission path of the ground plate 40A and the ground contact 18B.

In FIG. 11, an arrow F2 indicates the transmission path. Since the opponent connector 3A side (Z1 side) of the ground plate 40A and the opponent connector 3A side (Z1 side) of the plural ground contacts 18B are electrically connected to each other, it is possible to make the stub of the transmission path F2 narrow. Because of this, it is possible to prevent fluctuations of ground potential even in a case of high speed transmission. Hence, it is possible to improve an effect of ground against high frequency signals.

THIRD EXAMPLE

Figure 5:
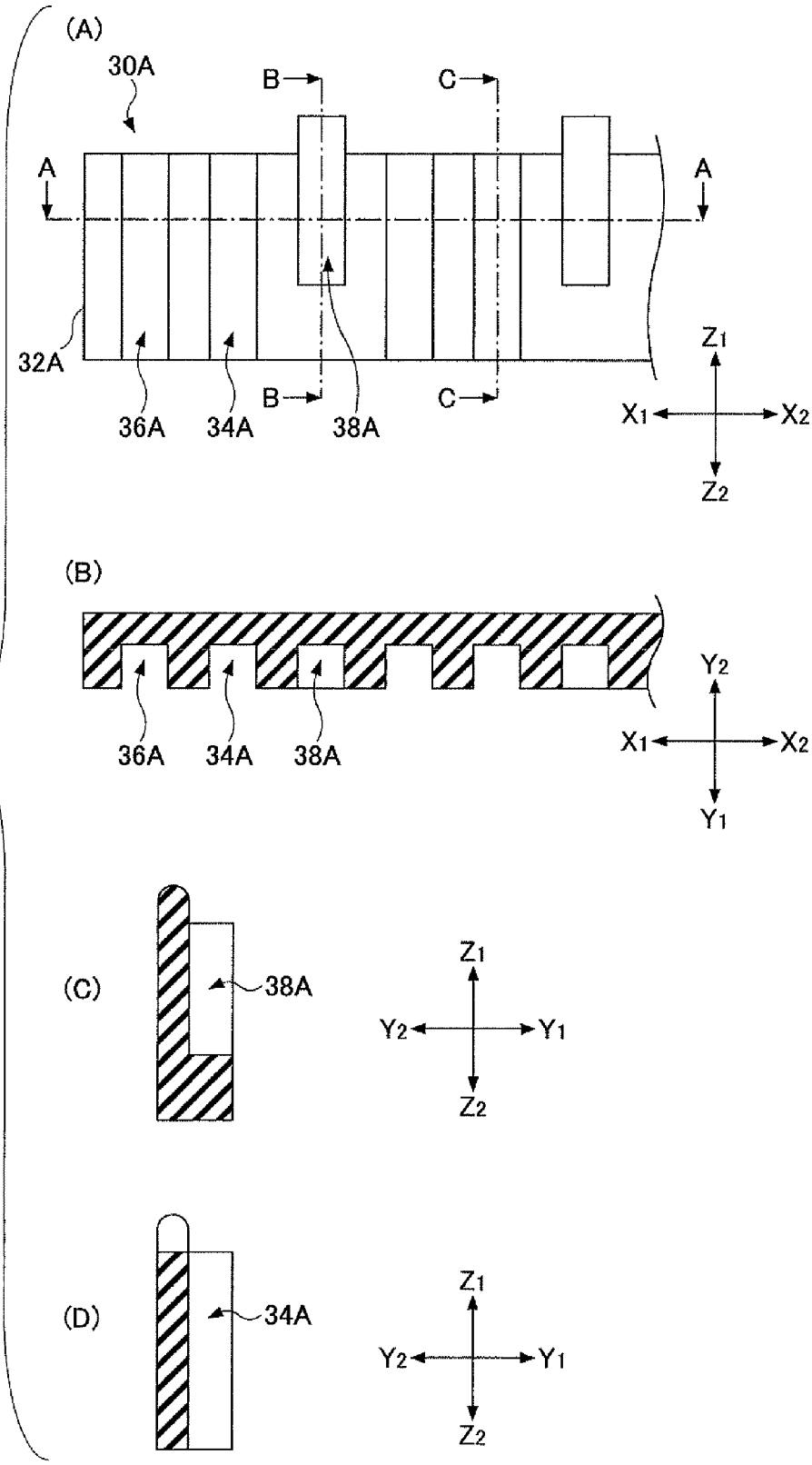
FIG. 5 is a view showing a structure of a projection part 30A.
Figure 6:
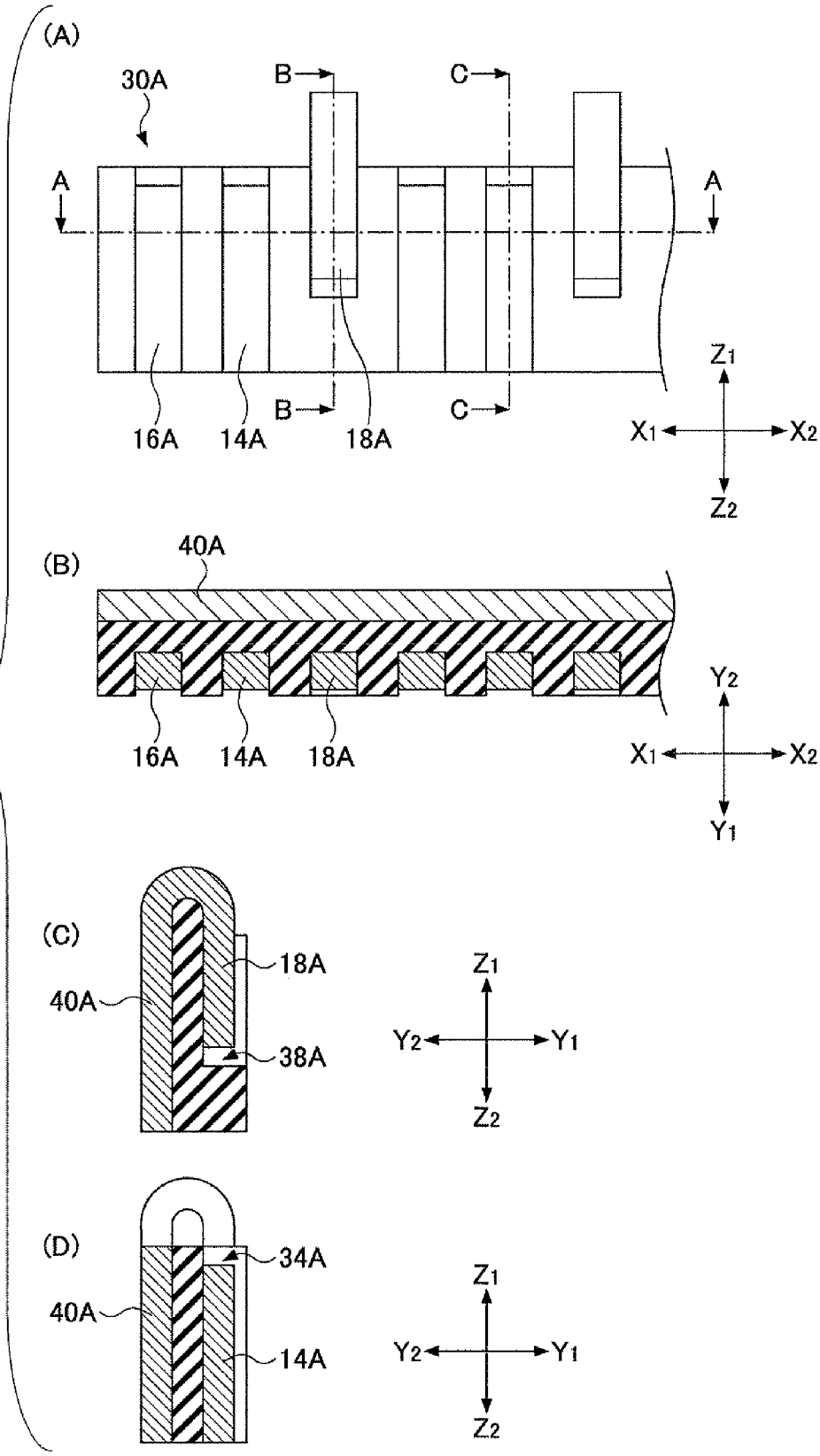
FIG. 6 is a view showing fitting states of contacts 14A, 16A and 18A.
Figure 12:
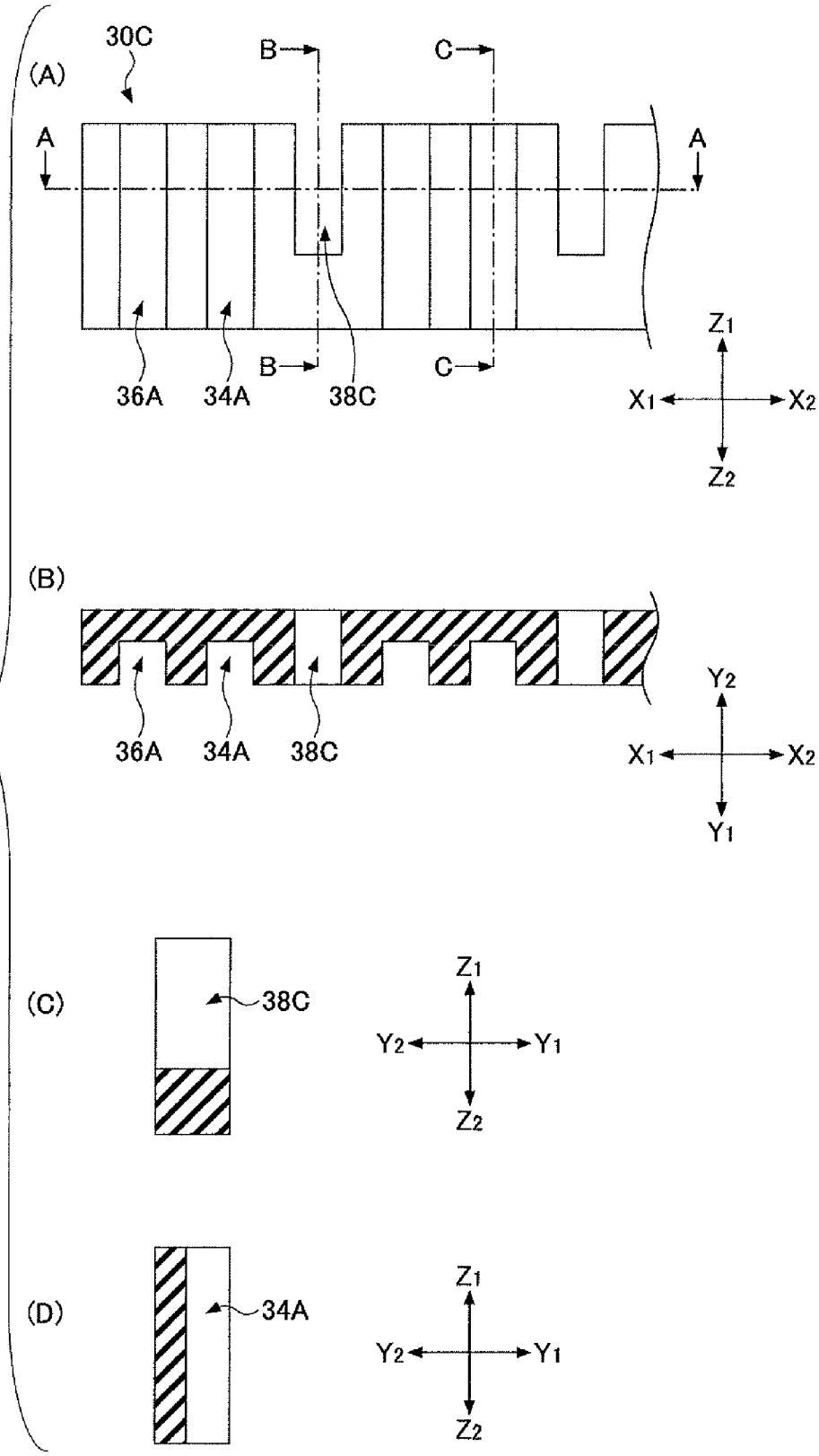
FIG. 12 is a view showing a structure of a projection part 30C.

A connector 2C of the third example of the present invention, compared to the connector 2A illustrated in FIG. 4, includes a projection part 30C illustrated in FIG. 12 instead of the projection part 30A illustrated in FIG. 5.

Figure 13:
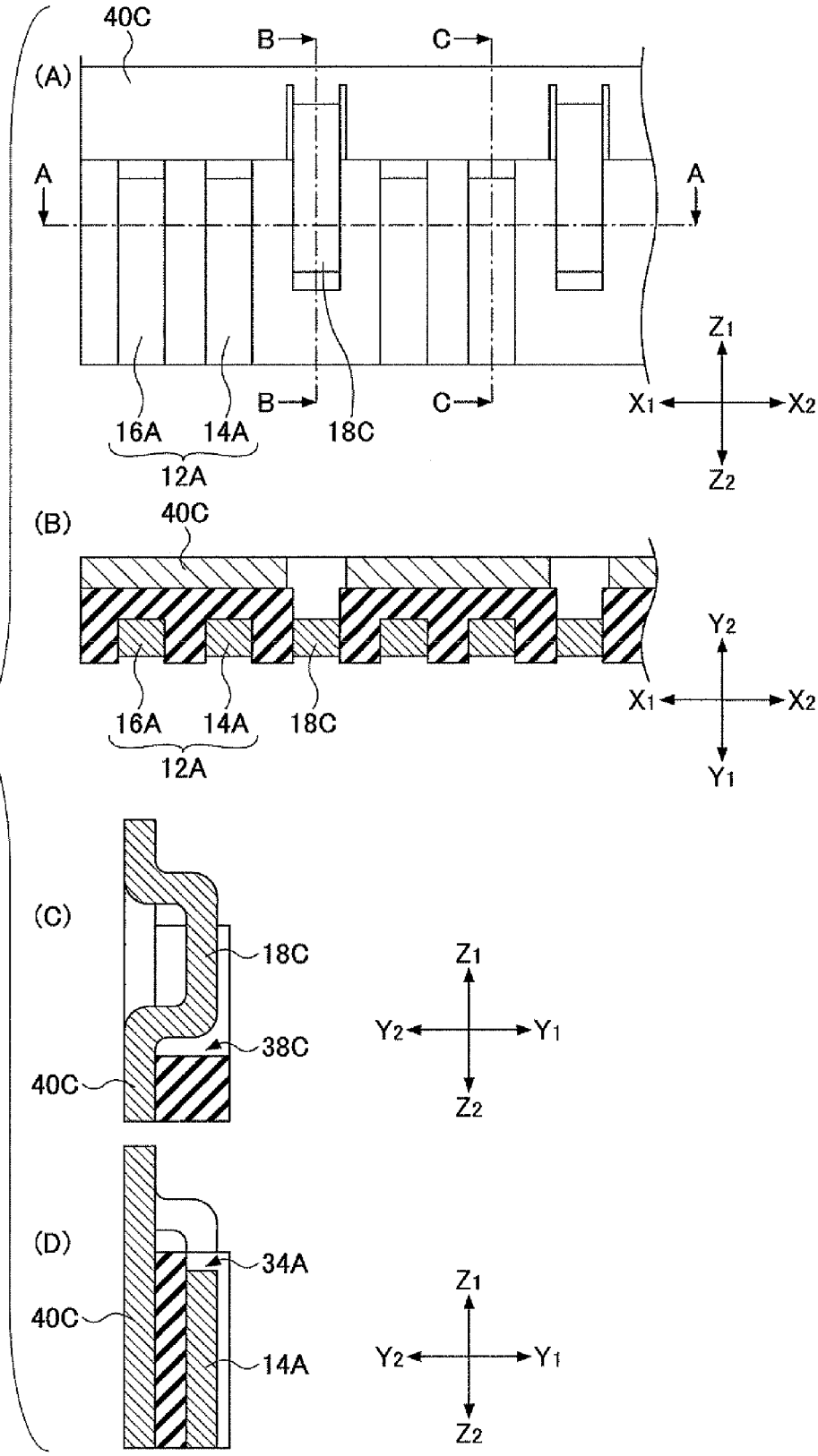
FIG. 13 is a view showing fitting states of the contacts 14A and 16A and a contact 18C.

FIG. 12 is a view showing a structure of the projection part 30C. FIG. 12(A) is a front view showing a structure of the projection part 30C. FIG. 12(B) is a view taken along line A-A. FIG. 12(C) is a view taken along line B-B. FIG. 12(D) is a view taken along line C-C. FIG. 13 is a view showing fitting states of contacts 14A, 16A and 18C. FIG. 13(A) through FIG. 13(D) correspond to FIG. 12(A) through FIG. 12(D), respectively.

The projection part 30C, compared to the projection part 30A shown in FIG. 5, includes a slit 38C for ground instead of the groove 38A for ground. The slit 38C is formed by cutting the projection part 30C from the Z1 side of the projection part 30C in the Z2 direction on the way of the projection part 30C. The slits 38C are placed side by side in the row direction (X1-X2 direction). The ground contacts 18C are press fitted in and fixed to the corresponding slits 38C.

Figure 14:
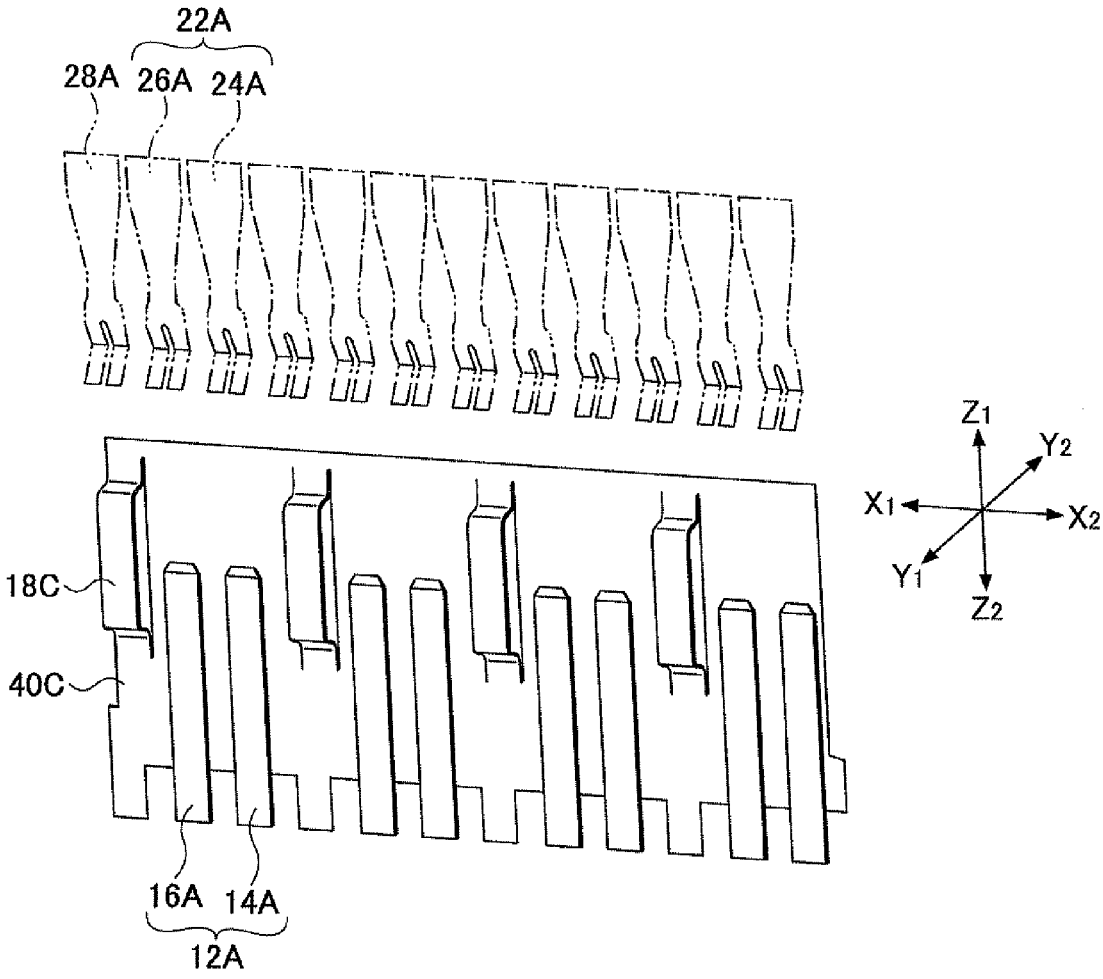
FIG. 14 is a perspective view showing a unit structure of the connector 2C.

The connector 2C of the third example of the present invention, compared to the connector 2A illustrated in FIG. 4, includes a ground plate 40C and a ground contact 18C illustrated in FIG. 14 instead of the ground plate 40A and the ground contact 1SA illustrated in FIG. 7.

FIG. 14 is a perspective view showing a unit structure of the connector 2C.

In the example shown in FIG. 14, the ground contacts 18C are formed as follows. That is, both ends in the extending direction (Z1-Z2 direction) of the ground contact 18C are connected to the ground plate 40C in a body. In addition, the ground contact 18C is plastically formed in a rectangular-shaped configuration without one side, so that a middle part projects in the extending direction.

Figure 15:
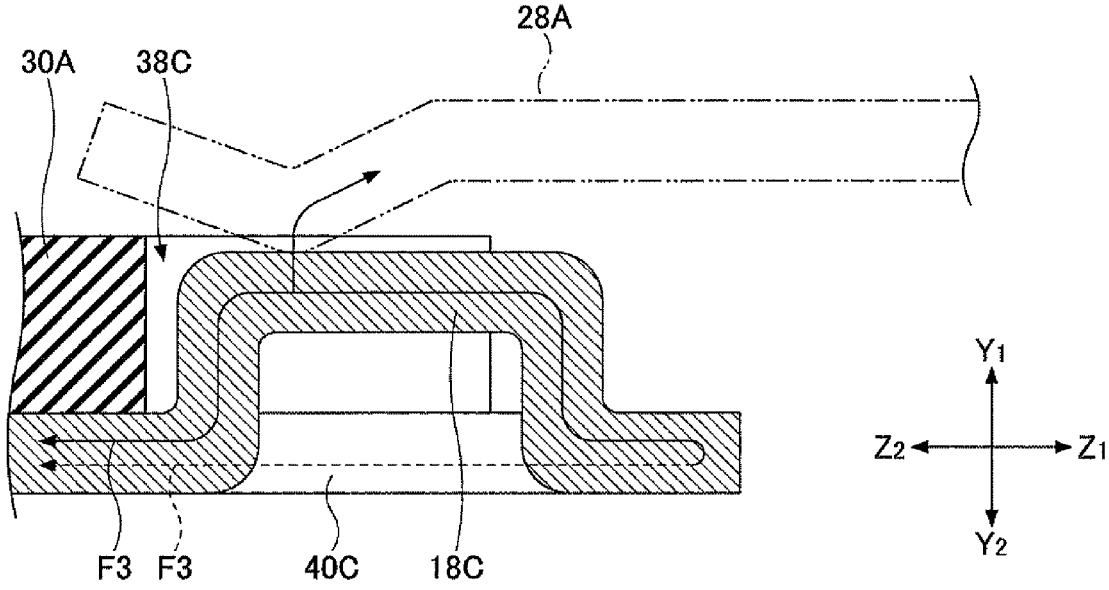
FIG. 15 is a cross-sectional view of a transmission path of a ground plate 40C and a ground contact 18C.

FIG. 15 is a cross-sectional view of a transmission path of the ground plate 40C and the ground contact 18C.

In FIG. 15, an arrow F3 indicates the transmission path. The opponent connector 3A side (Z1 side) of the ground plate 40C and the opponent connector 3A side (Z1 side) of the ground contacts 18C are electrically connected to each other. Both ends in the extending direction (Z1-Z2 direction) of the ground contact 18C are electrically connected to the ground plate 40C. Therefore, it is possible to avoid forming the stub of the transmission path F3. In addition, the transmission direction of a shortest transmission path between the opponent connector 3A and the outside board (back plane) can be made a forward direction (single direction).

Because of this, it is possible to prevent fluctuations of ground potential even in a case of high speed transmission. Hence, it is possible to improve an effect of ground against high frequency signals.

FOURTH EXAMPLE

A connector 2D of the fourth example of the present invention, compared to the connector 2A illustrated in FIG. 4, includes a projection part 30C illustrated in FIG. 12 instead of the projection part 30A illustrated in FIG. 5. The connector 2D of the fourth example of the present invention, compared to the connector 2A illustrated in FIG. 4, includes a ground contact 18D and a ground plate 40D illustrated in FIG. 16 instead of the ground contact 18A and the ground plate 40A illustrated in FIG. 7.

Figure 16:
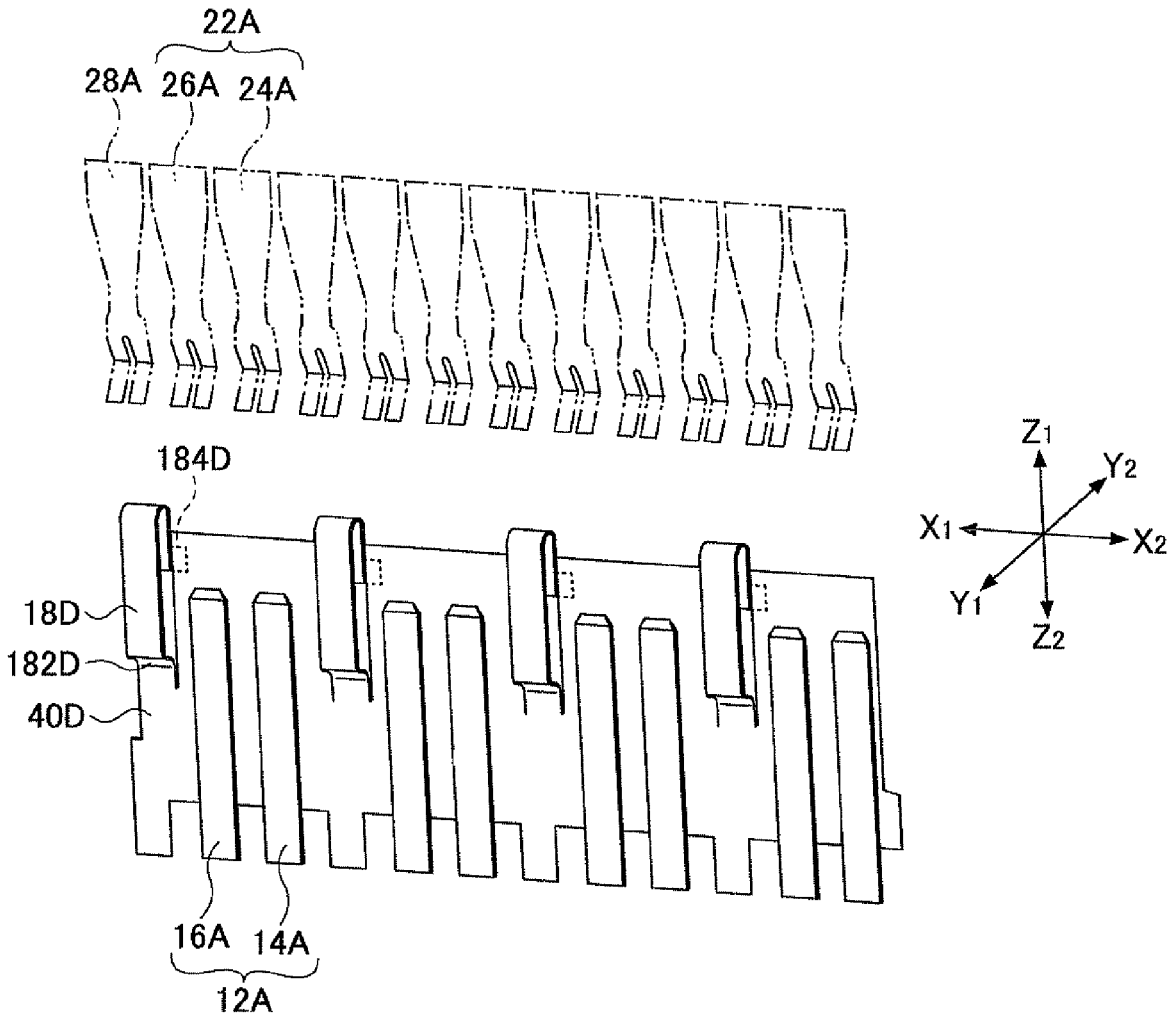
FIG. 16 is a perspective view showing a unit structure of the connector 2D.

FIG. 16 is a perspective view showing a unit structure of the connector 2D.

In the unit structure, the ground contacts 18D and the ground plate 40D, similar to the ground contacts 18A and the ground plate 40A, are formed in a body by punching a single metal plate in a comb tooth manner and cutting up the comb tooth part in a belt manner. Plural pieces being cut up form the ground contacts 18D. Because of this, it is possible to decrease the number of components.

In the ground contact 18D of an example shown in FIG. 16, a base end part (Z2 side end part) 182D is cut up from the ground plate 40D in the Y1 direction so as to obliquely extend in the Z2 direction. A head part (Z1 side end part) 184D is bent in a U-shaped manner in a direction (Y2 direction) opposite to the cutting up direction (Y1 direction).

The head end part 184D includes projection parts situated on both end surfaces in the X1-X2 direction. The projection parts come in contact with the rear surface (Y2 side surface) of the opponent connector 3A side (Z1 side) of the ground plate 40D.

The base end part 182D forms a contact part whose surface can come in contact with the surface of the opponent ground contact 28A. The base end part 182D has a tilted surface which can come in contact with an elastically deformable V-shaped head end of the opponent ground contact 28A. Since the surface of the ground contact 18D and the surface of the opponent ground contact 28A come in contact with each other, it is possible to prevent bad contacts. Because of this, it is possible to improve the effect of ground against high frequency signals.

Plural contact parts 182D are provided between the neighboring signal contact pairs 12A one by one and at the X1 side or X2 side for all signal contact pairs 12A one by one. In other words, the signal contact pairs 12A and the contact parts 182D are alternately placed side by side in the row direction (X1-X2 direction).

Figure 17:
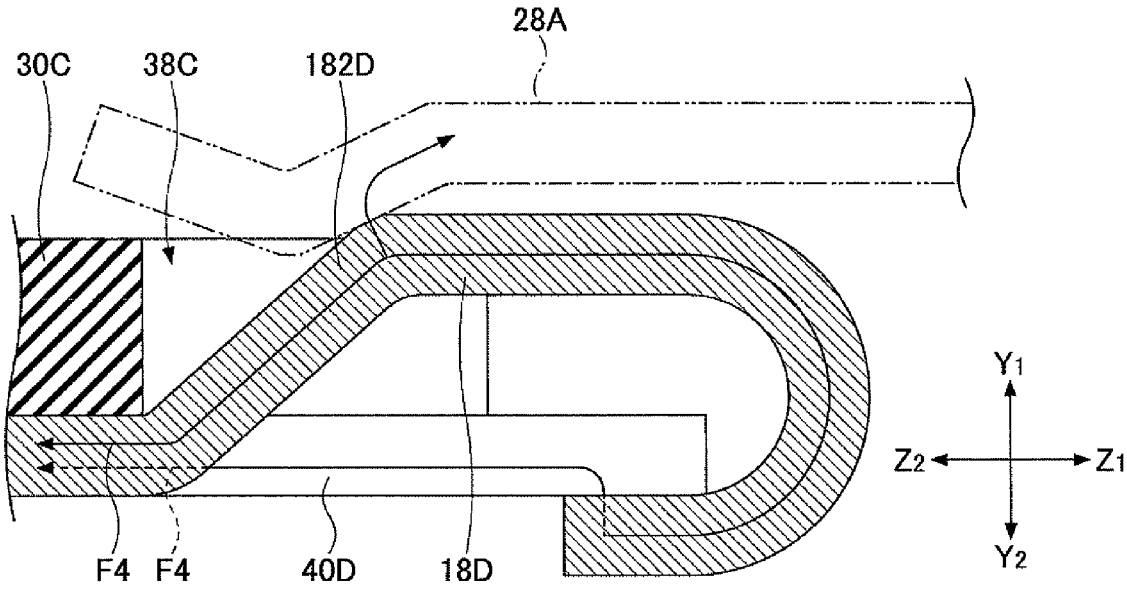
FIG. 17 is a cross-sectional view of a transmission path of a ground plate 40D and a ground contact 18D.

FIG. 17 is a cross-sectional view of a transmission path of the ground plate 40D and the ground contact 18D.

In FIG. 17, an arrow F4 indicates the transmission path. The opponent connector 3A side (Z1 side) of the ground plate 40D and the opponent connector 3A side (Z1 side) of the ground contacts 18D are electrically connected to each other.

Both ends in the extending direction (Z1-Z2 direction) of the ground contact 18D are electrically connected to the ground plate 40D. Therefore, it is possible to avoid forming the stub of the transmission path F4. In addition, the transmission direction of a shortest transmission path between the opponent connector 3A and the outside board (back plane) can be made a forward direction (single direction).

Because of this, it is possible to prevent fluctuations of ground potential even in a case of high speed transmission. Hence, it is possible to improve an effect of ground against the high frequency signal.

As discussed above, according to the example 1 through the example 4, since the opponent connector 3A side (Z1 side) of the ground plate 40A (40C, 40D) and the opponent connector 3A side (Z1 side) of plural ground contacts 18A (18B, 18C, 18D) are electrically connected to each other, it is possible to make the stub of the transmission path F1 (F2, F3, F4) narrow. Because of this, it is possible to prevent fluctuations of ground potential even in a case of high speed transmission. Hence, it is possible to improve an effect of ground against high frequency signals.

In addition, according to the example 2 and the example 4, the ground contact 18B (18D) has the contact 182B (182D) where the surface of the opponent ground contact 28A can come in contact. Therefore, it is possible to prevent a bad or incomplete contact. Because of this, it is possible to improve the effect of ground against high frequency signals.

Furthermore, according to the example 3 and the example 4, the opponent connector 3A side (Z1 side) of the ground plate 40C (40D) and the opponent connector 3A side (Z1 side) of plural ground contacts 18C (18D) are electrically connected to each other. Both ends in the extending direction (Z1-Z2 direction) of the ground contact 18C (18D) are electrically connected to the ground plate 40C (40D). Therefore, it is possible to avoid forming the stub of the transmission path F3 (F4). In addition, the transmission direction of a shortest transmission path between the opponent connector 3A and the outside board (back plane) can be made a forward direction (single direction).

Because of this, it is possible to prevent fluctuations of ground potential even in a case of high speed transmission. Hence, it is possible to improve an effect of ground against high frequency signals.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority or inferiority of the invention. Although the embodiments of the present invention have been described in detail, it should be understood that the various changes, substitutions, and alterations could be made hereto without departing from the spirit and scope of the invention.

For example, in the examples 1 through 4, as shown in FIG. 6 and FIG. 13, the signal contacts 14A and 16A are press fitted in and fixed to the projection part 30A (30C). However, the present invention is not limited to this structure. The signal contacts 14A and 16A may be press fitted in and fixed to through holes piercing the bottom wall 62A of the insulation housing 8A (8C) in the thickness direction (Z1-Z2 direction). In this case, it is not necessary to provide the projection part 30A (30C).

What is claimed is:

1. A connector to be engaged with and connected to an opponent connector, the connector comprising:

a ground plate extending in a first direction;

a plurality of first signal contacts placed side by side in the first direction, the plurality of first signal contacts being configured to come in contact with a plurality of second signal contacts of the opponent connector; and a plurality of first ground contacts placed side by side in the first direction, the plurality of first ground contacts being configured to come in contact with a plurality of second ground contacts of the opponent connector;

wherein the ground plate and the first ground contacts are formed in a unified body by processing a single metal plate;

the ground plate and the first ground contacts are electrically connected to each other at opponent connector sides thereof; and the first ground contacts are shifted toward the opponent connector relative to the first signal contacts so as to come in contact with the second ground contacts of the opponent connector before the first signal contacts come in contact with the second signal contacts of the opponent connector.

2. The connector as claimed in claim 1, wherein each of the first ground contacts includes a contact part whose surface is configured to come in contact with a surface of a corresponding second ground contact of the opponent connector.

3. The connector as claimed in claim 1, wherein both ends in an extending direction of each of the first ground contacts are electrically connected to the ground plate.

4. The connector as claimed in claim 1, wherein each of the first ground contacts is formed by bending a part of a metal plate in a U-shaped manner.

5. The connector as claimed in claim 1, wherein each of the first ground contacts is formed by making two slits in the ground plate, and protruding a part of the ground plate between the two slits from the ground plate in a thickness direction of the ground plate.

6. The connector as claimed in claim 1, wherein the first ground contacts are formed so as to extend from the ground plate toward the opponent connector.

* * * * *